US005825267A

United States Patent [19]

Smith

[11] Patent Number: 5,825,267

[45] Date of Patent: Oct. 20, 1998

[54] FILTER TUNING ASSMEBLY

[75] Inventor: Patrick A. Smith, Northfield Center, Ohio

[73] Assignee: Allen Telecom Inc., Solon, Ohio

[21] Appl. No.: 899,687

[22] Filed: Jul. 24, 1997

[51] Int. Cl.[6] ..... H01P 7/06

[52] U.S. Cl. ..... 333/235; 333/202; 333/232

[58] Field of Search ..... 333/202, 219.1, 333/235, 207, 223–226, 231–233; 331/96; 411/171, 533, 372, 377

[56] References Cited

U.S. PATENT DOCUMENTS

| | | | |
|---|---|---|---|
| 4,484,162 | 11/1984 | Kamada et al. | 331/96 X |
| 4,681,497 | 7/1987 | Berecz | 411/377 |
| 4,706,053 | 11/1987 | Giavarini | 333/235 X |
| 4,948,318 | 8/1990 | Nottelmann et al. | 411/377 |

OTHER PUBLICATIONS

Takayama et al., "Stabilized C–Band GaAs FET Oscillator", Microwave Journal, vol. 20, No. 10, pp. 52, 55, Oct. 1977.

*Primary Examiner*—Seungsook Ham
*Attorney, Agent, or Firm*—Laff, Whitesel, Conte & Saret, Ltd.

[57] ABSTRACT

A tuning assembly for an RF filter having an internal cavity. The tuning assembly is mounted on one of the filter walls and comprises an adjustment screw threadedly secured in the wall and having an inner end in the cavity and an outer free end external of the wall, a generally circular tuning plate, and a formed in situ molded connector fixedly securing the tuning plate to the inner end of the screw and for preventing relative movement therebetween. A formation is provided at the free end of the adjustment screw for facilitating rotation of the adjustment screw relative to the wall so that the tuning plate may be moved within the cavity toward and away from the wall.

6 Claims, 2 Drawing Sheets

FIG. 1
PRIOR ART
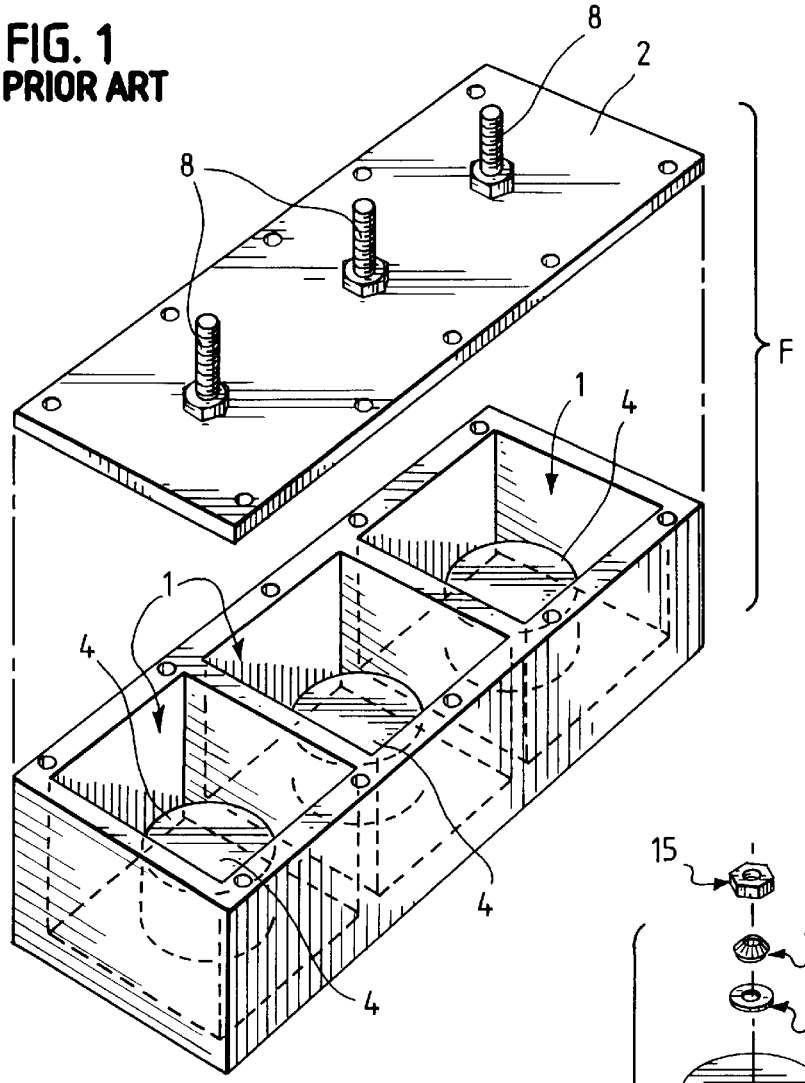
FIG. 2
PRIOR ART
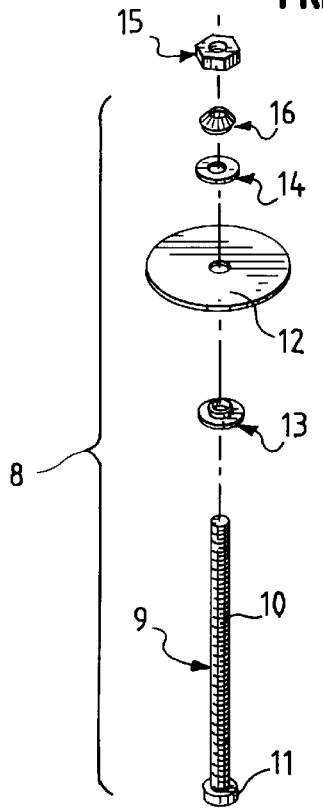
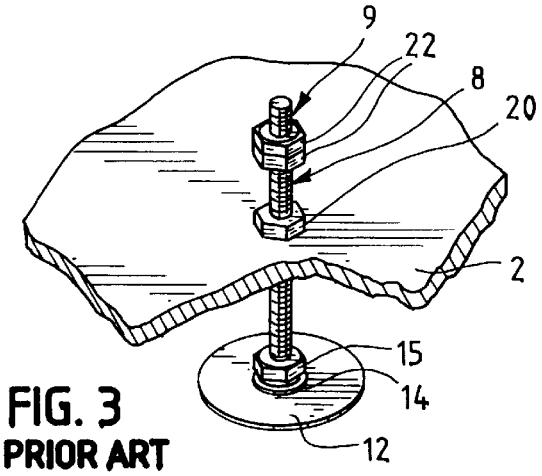
FIG. 3
PRIOR ART

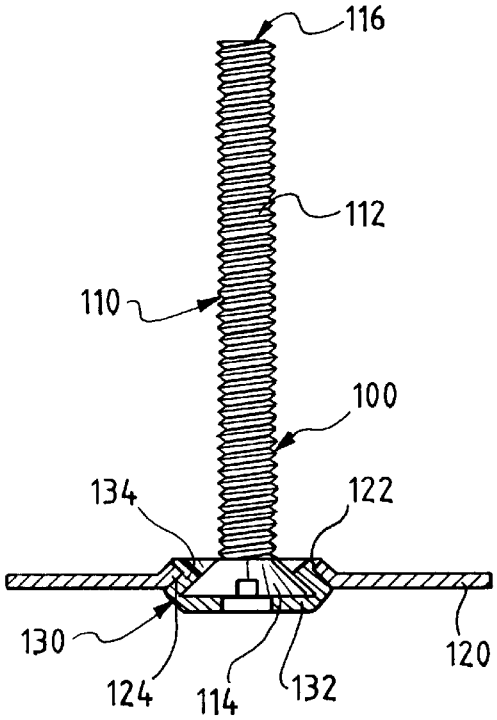
FIG. 4
FIG. 5
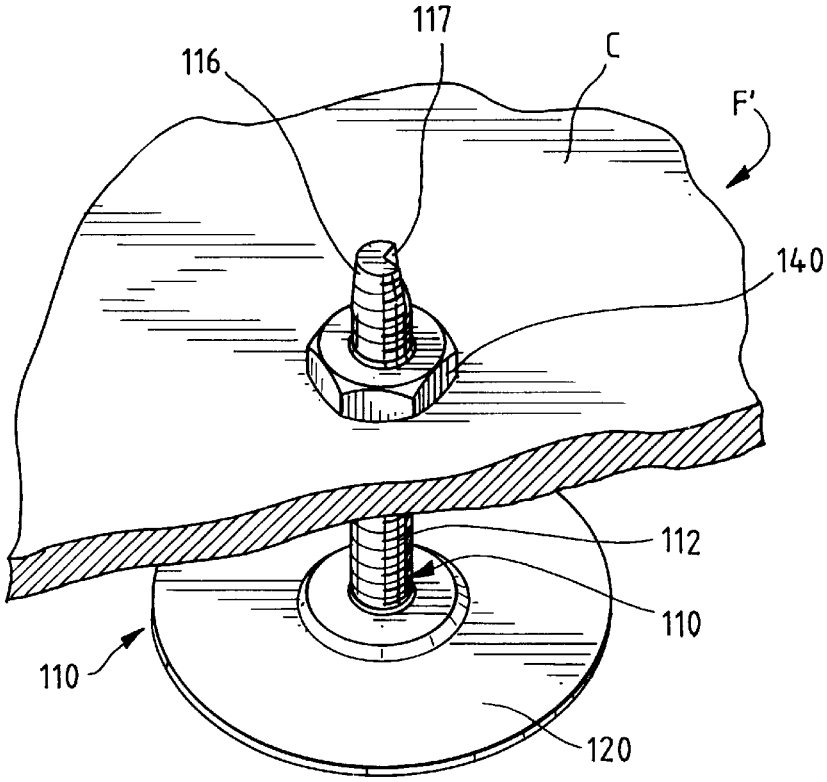

FILTER TUNING ASSMEBLY

BACKGROUND OF THE INVENTION

A variety of assemblies have been proposed and are used for properly positioning and then seeking to maintain the precise location of a tuning plate in a filter.

Presently used tuning assemblies frequently employ a substantial number of parts requiring time consuming assembly. Further, many are difficult to precisely fix in position after adjustment whereby it is substantially guaranteed that they remain in their adjusted, tuned positions. Further, the constructions of tuning assemblies are frequently such that if they are brought into contact with a filter wall or cover to which they are threadedly connected for tuning adjustment, they may sometimes become unthreaded in part, thereby causing portions of the tuning assembly to loosen and the filter to fail to operate properly and within specifications.

It would be of advantage to provide a tuning assembly which has a minimum number of parts, which is easy to manufacture and assemble, and which, when adjusted, may be fixed in position with certainty and confidence that the adjusted position will be retained.

SUMMARY OF THE INVENTION

In accordance with the present invention, an improved RF filter is provided. The RF filter comprises an enclosure formed of walls defining an interior cavity and has a tuning assembly mounted on one of the walls. The tuning assembly comprises an adjustment screw threadedly secured in the one wall and has an inner end in the cavity and an outer free end external of the enclosure, a generally circular tuning plate, and a molded connector fixedly securing the tuning plate to the inner end and for preventing relative movement therebetween. At the free end of the adjustment screw, means are provided for facilitating rotation of the adjustment screw relative to the one wall so that the tuning plate may be moved toward and away from the one wall within said cavity.

In a preferred form, the tuning plate defines a central opening and the inner end is a screw head, and the connector has a first portion overlying the screw head and a second integral portion embracing the central opening. The central opening may comprise a dished annulus and the screw head may have a frustoconical lower surface confronting the dished annulus, with the second embracing portion being interposed between the lower surface and the dished annulus.

Desirably, the molded connector is a plastic connector and is molded in situ to secure the tuning plate to the inner end. In a preferred form, the molded connector is a fiber-filled polyetherimide plastic connector which is essentially RF transparent.

The molded connector preferably projects beyond the tuning plate in the direction of the one wall so that if the tuning plate is moved into close adjacency with the one wall, the connector will contact the wall rather than the tuning plate contacting the wall. The means at the free end of the adjustment screw may desirably be a shaped formation for providing tool purchase to facilitate rotation of the adjustment screw.

Further objects, features and advantages of the present invention will become apparent from the following description and drawings.

BRIEF DESCRIPTION OF THE DRAWINGS

FIG. 1 is a schematic perspective view of a representative prior art filter;

FIG. 2 is a fragmentary view of a portion of FIG. 1 showing a typical prior art tuning assembly;

FIG. 3 is an exploded perspective view of the prior art tuning assembly of FIG. 2;

FIG. 4 is a schematic perspective view of a tuning assembly constructed in accordance with the present invention; and FIG. 5 is an enlarged, fragmentary view of a filter and the tuning assembly of FIG. 4 showing the tuning assembly and its manner of securance to an associated wall of the filter.

DETAILED DESCRIPTION

Referring first to FIGS. 1 to 3, they illustrate a typical prior art device, such as a filter F. Filter F is shown schematically in FIG. 1. Filter F comprises an enclosure formed of walls defining a series of cavities 1. One of the enclosure walls may be a removable cover 2. Filter F may be fabricated of copper, may be silver-plated or may otherwise be suitably prepared for cooperating with resonators, such as ceramic resonators 4, which are suitably supported therein in a conventional manner. Other conventional adjuncts such as irises, etc. may be employed as well.

One of the enclosure walls, such as the cover 2, mounts a tuning assembly 8, one for each resonator and cavity. A typical prior art tuning assembly 8 includes an adjusting screw 9 having a threaded shank 10 and a head 11. Screw 9 may be of steel. Screw 9 mounts a disc-shaped tuning plate 12. Plate 12 is straddled by an insulating bushing 13 and an insulating washer 14. Bushing 13 bears against the head 11 of screw 9. A nut, such as a hex nut 15, is provided to lock the plate 12 in position relative to head 11. An intermediate self-clinching washer 16 is positioned to complete the assembly at the head end of the tuning assembly 8.

Typically, the threaded shank 10 of screw 9 is threadingly engaged in a wall of the filter (such as in the cover 2) where it can be rotated to adjust the position of the plate 12 relative to the cavity 1 and to the contained resonator 4 until the filter F is properly tuned. Once tuning is completed, the tuning assembly 8 is locked in position, typically with a lock nut 20 bearing against the outside of the filter cover 2 and by one or more locking nuts 22.

It will be apparent that during adjustment the tuning screw 9, hence the tuning assembly 8, may be rotated freely. Thus, for example, if the tuning screw 9 is rotated in a counterclockwise direction during tuning, the threaded shank 10 and tuning plate 12 will move outwardly and away from the associated resonator 4. If the screw 9 is rotated excessively, the nut 15 may be brought into contact with the inner wall of the cover 2.

If the engaged wall surface is rough, the wall surface may "catch" the nut 15 and cause it to unscrew relative to the shank 10 of the screw 9, in which event, if the tuning screw 9 is later backed-off, the entire tuning assembly could become loose and the tuning plate 12 could, therefore, move relative to the screw 9. This could alter the tuning of the filter and can then result in an improperly functioning filter. Particularly when one considers that many filters use multiple tuning assemblies (as illustrated by filter F), each with multiple parts and each subject to the risks of inadvertent damage, as described, possible sources of failure are too great to be acceptable. These and other drawbacks of prior art tuning assemblies dictate the need for an improved tuning assembly.

Referring now to FIGS. 4 and 5, a one-piece tuning assembly 100 for a filter F' is there illustrated. Filter F' may be the same as filter F except, of course, for the tuning assembly. The tuning assembly 100 includes a tuning screw 110 to which a generally circular tuning plate 120 is secured. Tuning plate 120 may be about 23 mm in diameter. Screw 110 may desirably be a stainless steel Phillips flat head screw approximately 24 mm in length and may desirably have a thread-cutting shank 112. A stainless steel screw 110 is preferred for its greater strength when the shank 112 is used to provide wrench purchase. Screw 110 has a head 114 at one inner end. Its other end, the free end 116 which is external of the enclosure, defines a key-like means or formation 117 to provide tool purchase by which the tuning screw 110 may be rotated relative to the cover C so that the tuning plate 120 may be moved within the cavity toward and away from the cover C. The formation 117 may be a semi-cylindrical formation which is the portion of the end 116 remaining after a semi-cylindrical segment is removed.

As will be best seen from FIG. 4, plate 120 is generally flat except at its center where the zone 124 immediately surrounding the central opening 122 is generally concave. Preferably, the concave zone 124 is shaped to provide a dished annulus or conical configuration which has a surface which is generally parallel to the frustoconical confronting surface of the confronting screw head 114.

The screw head 114 and plate 120 are desirably integrated in a mold, thereby to provide a permanent connection. To that end, a tuning plate 120 and a tuning screw 114 are secured in position in situ in a mold (not shown) into which molten plastic is introduced. The screw head 114 and tuning plate 120 are positioned, in the orientation represented by FIG. 4, with the concave zone 124 and screw head 114 spaced apart to allow plastic to flow between them and to lock them together. As such, the plastic overlies the head 114 (while leaving access to the slots in the head) and embraces the tuning plate 120 around central opening 122. When the molten plastic solidifies, the screw 110 and plate 120 are permanently secured and connected via the formed molded connector element 130. A preferred molded plastic connector element 130 is a high strength, 30% glass fiber-filled, polyetherimide plastic which is essentially RF transparent and which is available from General Electric Company as ULTEM® 2310.

As will be seen, the connector element 130 comprises a first head portion 132 which overlies the head 114 of screw 110. Connector element 130 also defines a second integral embracing portion 134 which is joined to the head section 132 and which secures the tuning plate 120 to the tuning screw 110.

The connector element 130 is configured so that if the tuning assembly 100 is rotated inwardly of the filter interior (clockwise) until it contacts a confronting member connector element 130, such as a resonator, it will be the plastic rather than the metal of the screw which will contact the confronting member, thereby minimizing possible damage to the resonator. Similarly, because the molded connector projects beyond the tuning plate in the direction of the cover C, if the screw 110 is rotated outwardly (counterclockwise) until the tuning plate is moved into close adjacency with the cover, it will be the plastic connector which will contact the wall rather than the tuning plate. The plastic is unlikely to be affected by a rough wall finish, as metallic portions of prior art tuning assemblies tend to be.

When the one-piece tuning assembly 100 is secured to the filter wall, and is then adjusted in its threaded opening to its correct position relative to the filter F', it is locked in position, as against cover C, by a lock nut 140, this being the sole additional piece required for the tuning assembly 100.

As will be seen, in the illustrated embodiment, the tuning plate 120 is thin and flat. Because tuning plate 120 is secured within the projection of the head 114 of the screw 110 and because there are no additional fastening elements used (like those of the prior art tuning assembly of FIGS. 1 to 3), the tuning plate 120 may move between extreme outer positions of very close adjacency to the cover C and to inner portions of close adjacency to the surface of the resonator which it confronts, all without deleterious contact. Further, the use of plastic, rather than metal fasteners, especially such as a fiber-filled, polyetherimide which is essentially transparent to RF radiation, means that electrical design characteristics of a filter or other component with which the tuning assembly of the present invention is used may be precisely maintained.

Although rectilinear filters have been illustrated as being advantageously provided with tuning assemblies of the present invention, other radio frequency components having more or fewer resonators and of other configurations, such as cylindrical configurations, may also benefit from the use of tuning assemblies according to the present invention. Other screws and other configurations at the ends of screws and at an adjoining tuning plate may be configured to lock with each other via an insulative molded connector which secures them together against relative movement and against displacement in use and service.

Because of the small thickness of the interface zone of the tuning plate and tuning screw of the present invention, there is a greater range of screw adjustment possible between the filter wall mounting the tuning assembly and the resonator. This gives a greater allowable range of the resonator frequencies. The use of a high strength plastic connector which is RF transparent eliminates the effects of additional metal elements (such as those used in prior art tuning assemblies) and also provides a rigid assembly which is not affected by extremes of adjustment. The connector elements facilitate access to the Phillips screw drive socket. Use of a thread cutting screw, such as a type 23 thread cutting screw, advantageously acts as a thread chaser for threads in the cover, and thereby overcomes threading issues due to plating, sand, etc. The thread cutting screw also provides wrench purchase for turning the screw from the threaded end.

From the foregoing, it will be apparent to those of ordinary skill in the art that modifications may be made without departing from the spirit and scope of the invention. Accordingly, I do not intend to be limited except as may be necessary in view of the appended claims.

What is claimed is:

1. An RF filter comprising an enclosure formed of walls defining an interior resonant cavity;

a tuning assembly mounted on one of said walls;

said tuning assembly comprising an adjustment screw threadedly secured in said one wall and having an inner end in the cavity and an outer free end external of the enclosure, a generally circular tuning plate, and a molded plastic connector fixedly securing said tuning plate to said inner end and permanently preventing relative movement therebetween; and means at said free end of said adjustment screw for facilitating rotation of said adjustment screw relative to said one wall so that said tuning plate may be moved toward and away from said one wall within said cavity and wherein said means at the free end of the adjustment screw comprises a shaped formation thereat for providing tool purchase to facilitate rotation of the adjustment screw.

2. An RF filter in accordance with claim 1, and wherein said tuning plate defines a central opening and said inner end is a screw head, and wherein said connector has a first portion overlying said screw head and a second integral portion embracing said central opening.

3. An RF filter in accordance with claim 2, and wherein said central opening is a dished annulus and said screw head has a frustoconical lower surface confronting said dished annulus, and said second embracing portion is interposed between said lower surface and said dished annulus.

4. An RF filter in accordance with claim 2, and wherein said molded connector is a plastic connector and is molded in situ to secure said tuning plate to said inner end.

5. An RF filter in accordance with claim 1, and wherein said molded connector projects beyond said tuning plate in the direction of said one wall so that if said tuning plate is moved into close adjacency with said one wall, said connector will contact said wall rather than said tuning plate contacting said wall.

6. An RF filter in accordance with claim 1, and wherein said molded connector is a fiber-filled polyetherimide plastic connector which is essentially RF transparent.

* * * * *